US006149461A

United States Patent [19]

Emery

[11] Patent Number: 6,149,461

[45] Date of Patent: Nov. 21, 2000

[54] SOLDERLESS COAXIAL CABLE TERMINATION MOUNTING DEVICE

[75] Inventor: William M. Emery, Swanton, Ohio

[73] Assignee: ProComm, Inc., Grand Rapids, Ohio

[21] Appl. No.: 09/457,560

[22] Filed: Dec. 9, 1999

[51] Int. Cl.[7] ..... H01R 9/05

[52] U.S. Cl. ..... 439/578; 439/581; 439/582

[58] Field of Search ..... 439/578, 579, 439/580, 581, 582, 583, 584, 585, 63, 675

[56] References Cited

U.S. PATENT DOCUMENTS 3,954,321 5/1976 Casper ..... 439/582
4,066,324 1/1978 Stephens .

*Primary Examiner*—Paula Bradley
*Assistant Examiner*—Tho D. Ta
*Attorney, Agent, or Firm*—Emch, Schaffer, Schaub & Porcello Co., L.P.A.

[57] ABSTRACT

A solderless coaxial cable termination mounting device comprises a housing having a top and a bottom and an axially extending opening extending therethrough. A first eyelet is coaxially positioned in the opening adjacent the top of the housing. A second eyelet coaxially is positioned in the opening adjacent the bottom of the housing. The housing further defines a radially extending channel for receiving a coaxial cable. The coaxial cable has an internal wire which is in communication with the first eyelet and an external wire which is in communication with the second eyelet.

7 Claims, 3 Drawing Sheets

SOLDERLESS COAXIAL CABLE TERMINATION MOUNTING DEVICE

TECHNICAL FIELD

The present invention relates to a solderless coaxial cable termination mounting device for connecting a cable to an antenna and a ground potential base, and, in particular, to a mounting device which can be easily and inexpensively manufactured.

BACKGROUND OF THE INVENTION

In the industry of radio frequency equipment, antennas are connected to a coaxial cable by a connector which separates the two conductors of the coaxial cable. The center conductor is connected to the antenna while the outer conductor is connected to a ground potential base. Typically, the conductors are welded to either the antenna or the ground potential. The welding requires both skill and time in order to have a secure connection made which increases both the complexity and cost of the mounting device.

One early type of solderless connector described in the Stephens U.S. Pat. No. 4,066,324 has two plastic body halves which snap together. The ground or shield conductor passes through a hole in the top body half. The center conductor passes through a hole in the bottom body half. The two body halves are snapped together. Both body halves are compressed by a threaded component.

One drawback is that moisture can easily enter the Stephens '324 device between the body halves, causing corrosion and electrical shortages. Another drawback is that the Stephens '324 device has many components and is difficult to assembly. In particular, the orientation of the wire itself through the Stephens '324 device requires expert manual dexterity and is time consuming. Still another drawback of the Stephens '324 device is that the cable, which is positioned between the body halves, is not securely held to any mounting surface. Thus, cable in the Stephens '324 device is subjected to undesirable stresses and strains at the point where the cable leaves the body halves. Therefore, there is a need for an improved coaxial cable termination mounting device without these drawbacks.

SUMMARY OF THE INVENTION

The present invention is directed to a solderless coaxial cable termination mounting device comprising a housing having an axially extending opening extending therethrough, a first eyelet coaxially positioned in the opening adjacent the top of the housing, and a second eyelet coaxially positioned in the opening adjacent the bottom of the housing. The housing defines a radially extending channel for receiving a coaxial cable. The coaxial cable is positioned in the housing such that an internal wire of the coaxial cable is in connection with the first eyelet and an external wire of the coaxial cable which is in communication with the second eyelet.

The mounting device is operatively connected to an antenna assembly with a threaded screw which is coaxially positioned in the opening in the housing of the mounting device.

It is an object of the present invention to provide an improved coaxial cable termination mounting device which can be assembled without the need to solder any wires.

It is a further object of the present invention to provide an improved solderless coaxial cable termination mounting device which provides a dependable electrical connection without the need for solder.

It is a further object of the present invention to provide such mounting device that is useful to mount an antenna.

It is still a further object to provide such mounting device that is both easy and inexpensive to manufacture.

It is still a further object to provide such mounting device that is easy to use and which requires no complicated installation tools or instruction.

Additionally, another object of this invention is provide strain relief between an antenna and a mounting base while simultaneously providing a solderless coaxial cable connection.

Other objects, features and advantages of the present invention will become apparent to those skilled in the art upon a review of the following detailed description of the preferred embodiments and the accompanying drawings.

DETAILED DESCRIPTION OF THE INVENTION

Figure 2:
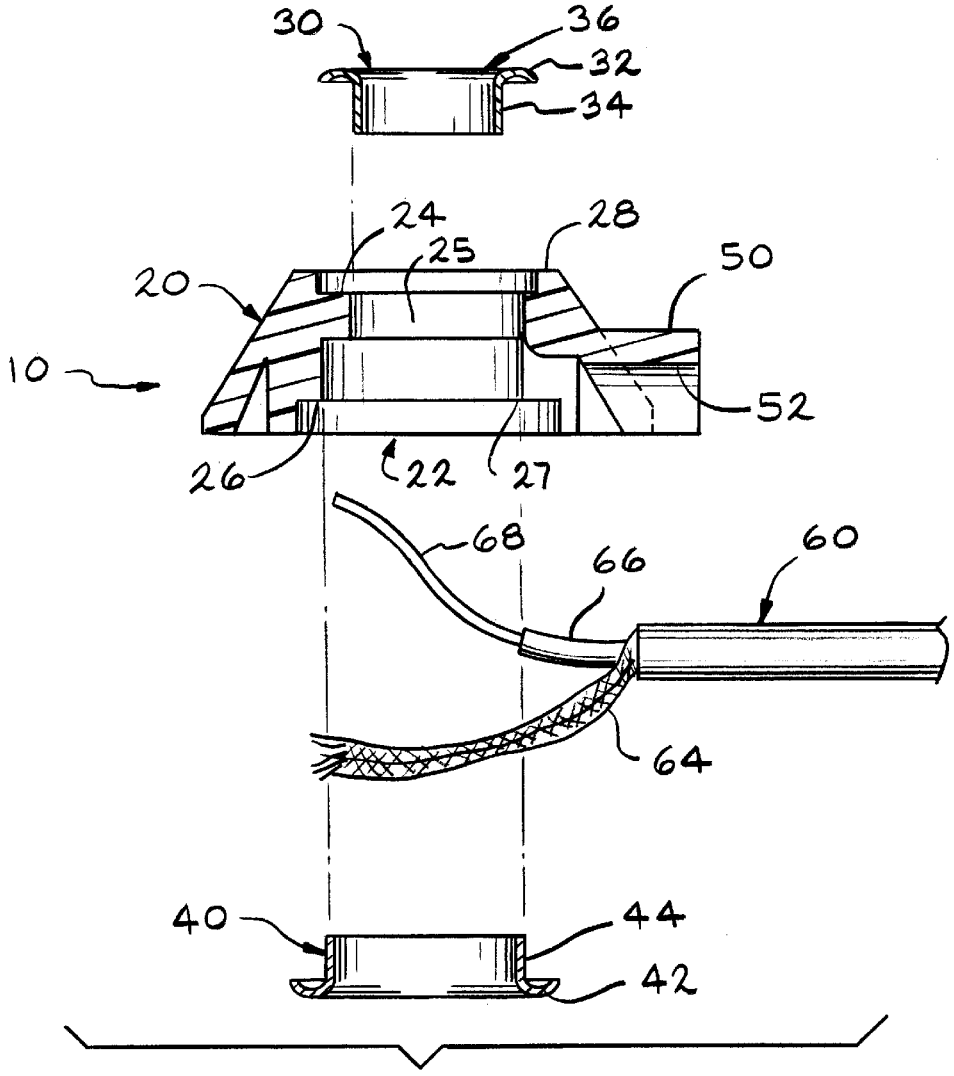
FIG. 2 is an exploded view, partially in cross-section, of a solderless coaxial cable termination mounting device.
Figure 3:
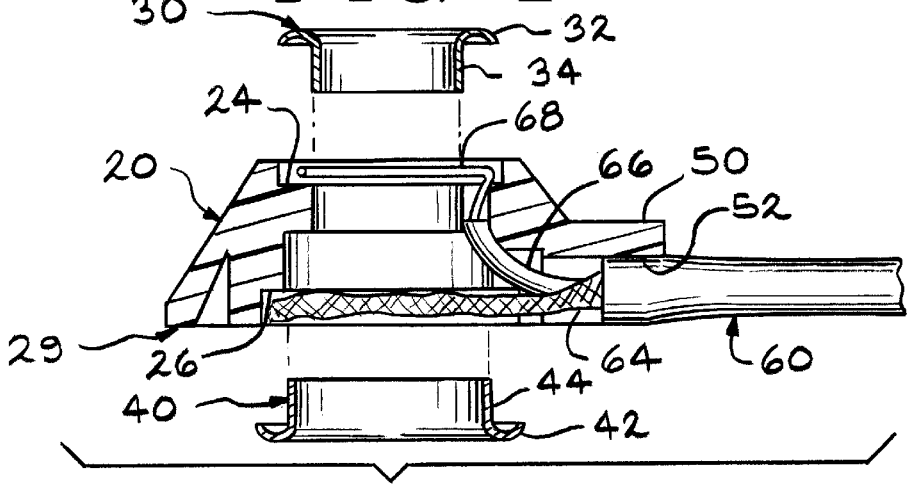
FIG. 3 is a partially exploded view, partially in cross-section, of a solderless coaxial cable terminator device.

Referring first to FIG. 2, a solderless coaxial cable termination mounting device 10 comprises a shell housing 20 which defines an axially extending opening 22. The shell body 20 defines a first inner shoulder 24 having a first diameter 25 and a second inner shoulder 26 having a second diameter 27. The first diameter 25 is smaller than the second diameter 27. A first eyelet 30 is coaxially positioned in close proximity or adjacent the shoulder 24. The first eyelet 30 has a flange 32 and a body 34 and defines an axially extending opening 36. The first eyelet 30 is preferably made of a conducting material such as brass. The flange 32 of the first eyelet 30 is positioned adjacent a top 28 of the housing 20. The body 34 of the first eyelet 30 axially extends into the opening 22 of the housing 20.

A second eyelet 40 is coaxially positioned in close proximity to or adjacent the second shoulder 26. The second eyelet 40 has a flange 42 and a body 44 and defines an axially extending opening 46. The eyelet 40 is preferably made of a conducting material such as brass. The flange 42 of the second eyelet 40 is adjacent a bottom 29 of the housing 20. The body 44 of the second eyelet 40 is positioned in the opening 22 of the housing 20.

The housing 20 further defines a channel 50 which extends in a radial direction from the opening 22. The channel 50 is in communication with the opening 22. The channel 50 extends from the first shoulder 24 through the second shoulder 26 and extends in a radial direction outward in a direction away from the opening 22. The channel 50 defines a radially extending opening 52.

The channel 50 receives a coaxial cable 60. Before assembly, the coaxial cable 60 is at least partially stripped of insulation and is inserted through the channel 50 in the housing 20. The coaxial cable 60 has an external insulation 62, external wires 64 positioned under the external insulation 62, an internal insulation 66 positioned under the external wires 64, and internal wires 68 positioned under the internal insulation 66.

The internal wires 68 extend through the channel 50 and extend into the opening 22. The internal wires 68 are positioned substantially circumferentially around the opening defined by the shoulder 24. The first eyelet 30 is axially positioned in the opening 22 such that the first eyelet 30 contacts the internal wires 68. The external wires 64 extend through the channel 50 and into the housing 20 adjacent the area defined by the diameter 27. The external wires 64 are positioned substantially circumferentially around the opening 22 defined by the shoulder 26. The second eyelet 40 is coaxially positioned in the opening 22 such that the second eyelet 40 contacts the antenna wires 64.

The first eyelet 30 acts as an electrical termination for the internal (or center) conducting wires 68 of the cable 60. The second eyelet 40 acts as an electrical termination for the external (or outer braid) conducting wires 64 of the coaxial cable 60. The first eyelet 30 and the second eyelet 40 are pressed into position in the opening 22 to firmly hold the conducting wires 68 and 64 in the device 20 without any soldering of the wires 64 and 68. The eyelets 30 and 40 are insulated from one another by the housing 20.

Figure 1:
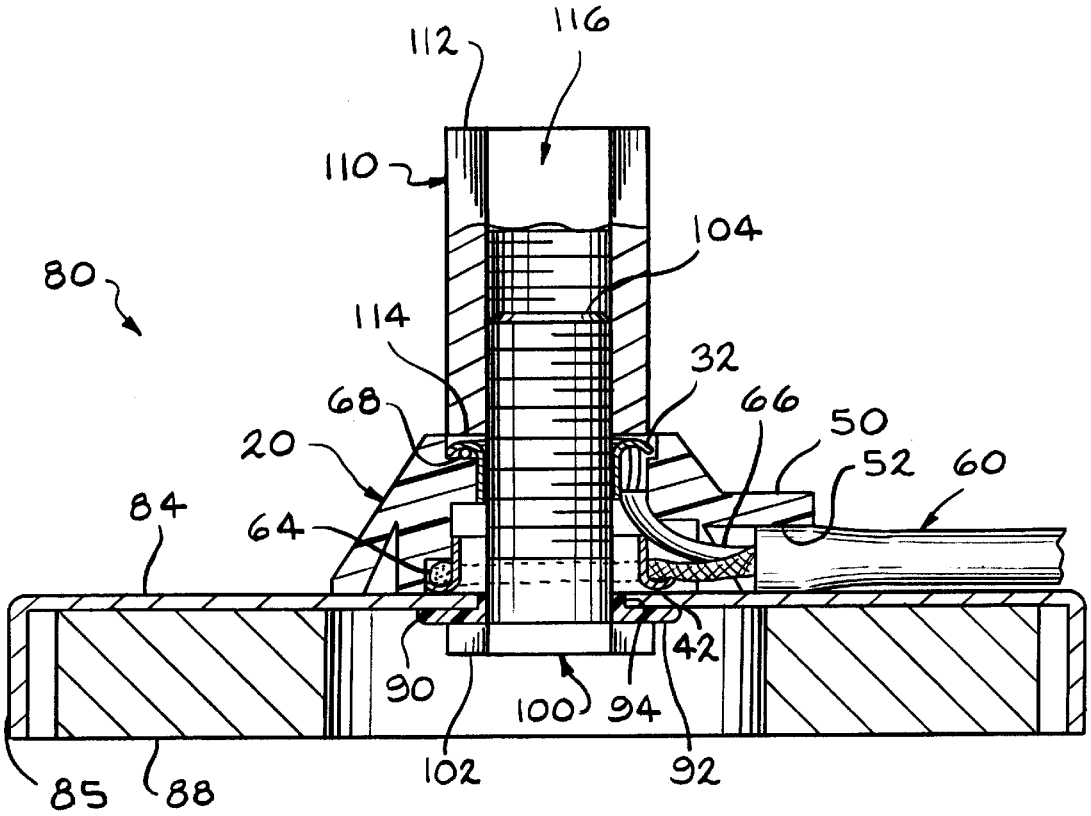
FIG. 1 is a cross sectional view of a solderless coaxial cable termination mounting device in an antenna assembly.
Figure 4:
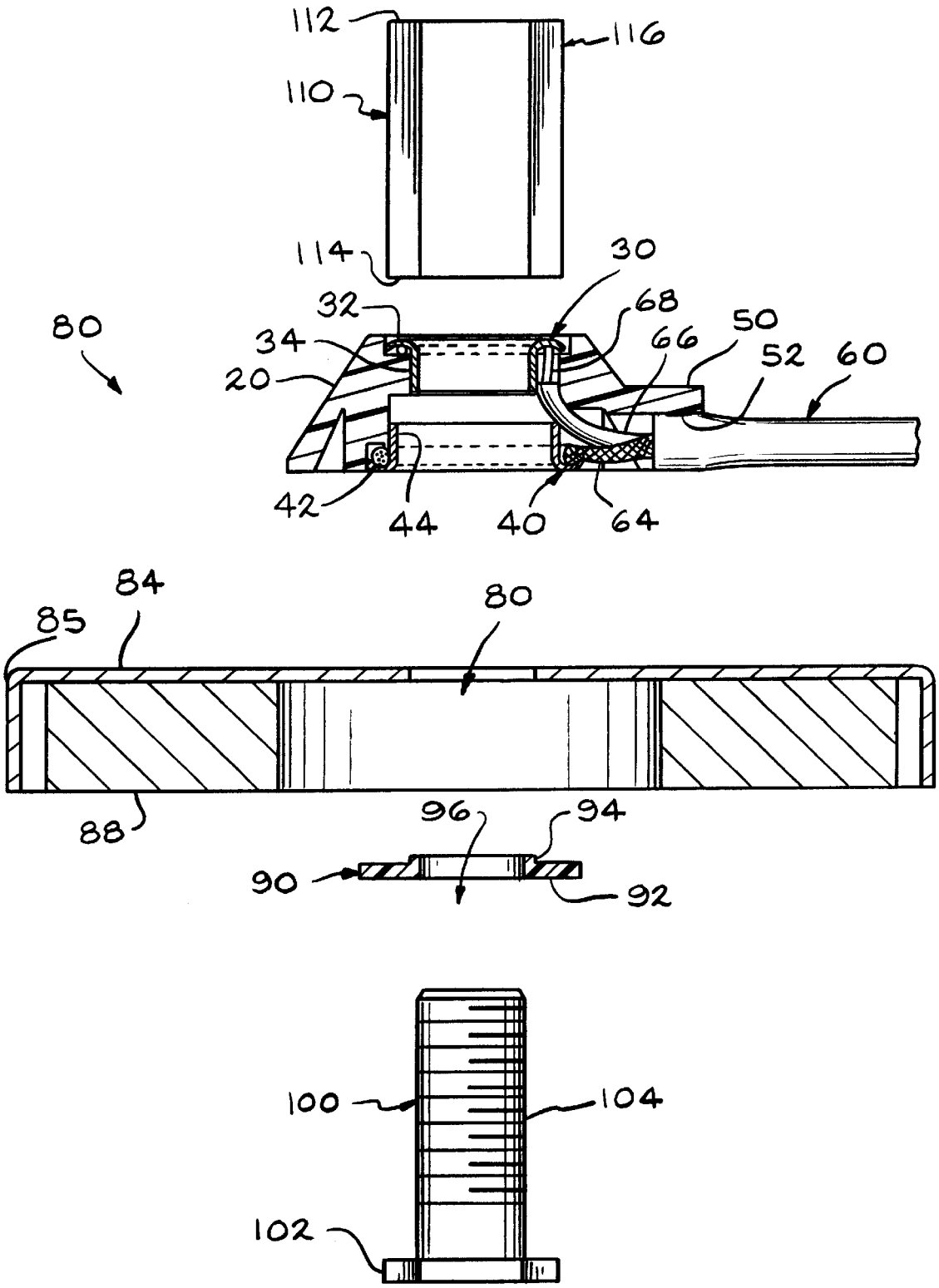
FIG. 4 is a partially exploded view, partially in cross-section, of a solderless coaxial cable terminator device in connection with an antenna assembly.

The mounting device 20 is readily assembled into an antenna assembly 80, as shown in FIGS. 1 and 4. The antenna assembly 80 generally includes a mounting base 82 which has a top portion 84 and a circumferentially extending portion 85. The mounting base 82 defines an axially extending opening 86. An insulating spacer washer 90 having a body 92 and a lip 94 is coaxially positioned in the opening 86. The washer 90 defines an axially extending opening 96. A magnet 88 is secured to the mounting base 82. The magnet 88 allows the assembly 80 to be removably adhered to a metal surface such as a car or truck roof.

A machine screw 100 is axially positioned in the opening 96 of the washer 90. The screw 100 has a head 102 and a threaded body 104. The threaded body 104 extends beyond the top 84 of the mounting base 82. The threaded body 104 of the screw 100 also extends through the opening 22 in the mounting device 20 and through the opening 36 in the first eyelet 30. The screw body 104 is in contact with the first eyelet 30.

An internally threaded screw component 110 has a first end 112 and a second end 114 and an axially extending opening 116. The internally threaded screw component 110 is threaded onto the body 104 of the screw 100 which extends beyond the top 28 of the mounting device 20.

When the screw component 110 is threaded onto the body 104 of the screw 110, the mounting device 20 is compressed between the screw component 110 and the mounting base 82. This compression further secures the conducting wires 68 and 64 to the antenna connector first eyelet 30 and to the ground potential base second eyelet 40, respectively.

The section of the coaxial cable 60 which extends from the housing 20 in the channel 50 is securely held in position against the mounting base 82. As the housing 20 and the housing channel 50 of the mounting device 20 are compressed between the screw component 110 and the mounting base 82 a desirable strain relief is provided to the coaxial cable mounting device.

The first eyelet 30 provides an electrical connection to an antenna (not shown) via the internally threaded screw machine component 110. The second eyelet 40 provides an electrical connection to the ground potential base via internally threaded screw component and the screw 100.

In use, the first eyelet 30 and the second eyelet 40 are in a spaced apart and coaxial relationship. The conductor wires 68 and 64 are wrapped around the eyelets 30 and 40, respectively. The eyelets 30 and 40 are placed in the shell housing 20 so that the conducting wires 68 and 64 are held firmly in place in the housing 20. A secure electrical connection is made without the need for any soldering of the wires 68 and 64 to the eyelets 30 and 40. The threaded screw 100 is axially extended through the washer 90 and base 82 and through the opening 22 in the housing 20. The internally threaded screw component 110 is threadingly engaged onto the screw 100 to compress the assembly 80. As the various components of the assembly are threaded together, the individual components are compressed ensure adequate connections as well as to ensure strain relief so that the antenna and assembly meet the consumer's durability requirements. By compressing the assembly, the desired antenna and ground potential connections are made further secure. In addition, the compression of the assembly further creates a strain relief between the antenna assembly and the coaxial cable.

The above detailed description of the present invention is given for explanatory purposes. It will become apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A solderless coaxial cable termination mounting device comprising:

a housing having an opening axially extending therethrough, an electrically conductive first eyelet coaxially positioned in the opening in the housing adjacent a top of the housing;

an electrically conductive second eyelet coaxially positioned in the opening in the housing adjacent a bottom of the housing;

the housing further defining a radially extending channel, said channel receives a coaxial cable, the coaxial cable having an internal wire which is in communication with the first eyelet and an external wire which is in communication with the second eyelet.

2. The device of claim 1, wherein the first eyelet and the second eyelet are in a spaced apart and insulating relationship in the housing.

3. The device of claim 1, wherein the internal wire of the coaxial cable substantially circumferentially extends around the first eyelet and wherein the external wire of the coaxial cable substantially circumferentially extends around the second eyelet.

4. The device of claim 3, wherein the first eyelet has a flange for engaging the internal wire adjacent a top shoulder of the housing and a body which coaxially extends into the opening in the housing.

5. The device of claim 3, wherein the second eyelet has a flange for engaging the external wire adjacent a bottom shoulder of the housing and a body which coaxially extends into the opening in the housing.

6. An antenna assembly comprising the solderless coaxial cable termination mounting device of claim 1, and further including a mounting base having an opening axially extending therethrough which is in a coaxial relationship to the axial opening in the housing;

an insulating washer coaxially positioned in the opening in the mounting base, the washer defining an axially extending opening;

a threaded screw having a head and a body, the body being coaxially positioned in the opening in the washer, the body of the threaded screw extending through each axial opening in the mounting device; and, an internally threaded screw component defining an axially extending opening, the body of the threaded screw being threadingly engaged in the opening in the internally threaded screw component whereby the mounting device is compressed between the mounting base and the internally threaded screw component.

7. The assembly of claim 6, further including a magnet operatively connected to the mounting base for securing the assembly to a suitable metal.

* * * * *